US007188378B2

(12) United States Patent
Ryan

(10) Patent No.: US 7,188,378 B2
(45) Date of Patent: Mar. 13, 2007

(54) SWIMMING POOL IMMERSED LIGHT FIXTURE

(76) Inventor: Richard T. Ryan, 5373 Aurora Road, Stouffville, On. (CA) L4A 7X4

( * ) Notice: Subject to any disclaimer, the term of this patent is extended or adjusted under 35 U.S.C. 154(b) by 141 days.

(21) Appl. No.: 10/802,817

(22) Filed: Mar. 18, 2004

(65) Prior Publication Data

US 2005/0204463 A1 Sep. 22, 2005

(51) Int. Cl.
*E04H 4/00* (2006.01)

(52) U.S. Cl. ..... 4/496; 4/492

(58) Field of Classification Search ..... 4/492, 4/496; 239/18; 362/96, 101
See application file for complete search history.

(56) References Cited

U.S. PATENT DOCUMENTS 5,207,499 A * 5/1993 Vajda et al. ..... 362/96
6,184,628 B1 * 2/2001 Ruthenberg ..... 362/362
6,435,691 B1 * 8/2002 Macey et al. ..... 362/101
6,616,291 B1 * 9/2003 Love ..... 362/101
6,949,894 B1 * 9/2005 Sullivan et al. ..... 362/101
6,971,760 B2 * 12/2005 Archer et al. ..... 362/101
2005/0044617 A1 * 3/2005 Mueller et al. ..... 4/496

* cited by examiner

*Primary Examiner*—Khoa D. Huynh

(57) ABSTRACT

A lighting system for use with an above-ground swimming pool includes a water access fixture extending through an aperture in the pool wall, for connection with the pool circulation system; and incorporates a sealed light assembly with a translucent cover; secured in depending adjoined, unitary relation with the access fixture. An extended electrical power cord connects with an external power supply and the light assembly, enabling removal of the light assembly from beneath the water, for repair or replacement. A rectifier/transformer 12-volt supply serves the planar array of LED lights, which may be R/G/B and programmed to give a spectrum of coloured lights.

11 Claims, 2 Drawing Sheets

50
52
54
12
16
14
13
17
10
15
34
42
28
36
60
30
30
32
40
38
18
26
58
44
48
30
24
46
20

SWIMMING POOL IMMERSED LIGHT FIXTURE

Cross-Reference to Related Applications—NOT APPLICABLE (N/A)

Statement Regarding Federally Sponsored Research Or Development—N/A

Reference To A Sequence Listing, A Table, Or A Computer Program Listing—N/A

Compact Disc Appendix—N/A

BACKGROUND OF THE INVENTION

1. This invention is directed to an underwater lighting system for use with swimming pools, and to a light fixture particularly suited for use with above-ground pools.

2. An earlier form of immersed light, as marketed in the United States by Pentair pool products under the name "AquaLuminator" (Trademark), consists of a light fitting that is located in the wall of a pool, within and centrally of the water inlet.

The Pentair fitting has a divergent flow diffuser, to divert inflowing water around the outside of the light fitting. This arrangement serves as a significant restriction to the free flow of water entering the pool from the pump/filter circulation system, with a marked increase in back-pressure and consequent undesirable changes in the operating characteristics of that system.

BRIEF SUMMARY OF THE INVENTION

The present invention provides a submerged pool lighting system, with a light fitting that forms part of and is integrally combined with a pool service water fitting.

The subject light fitting is combined with a circulation water fitting such as the pool water return fitting.

In a preferred system embodiment having a flanged water fitting for installation on the wall of the pool, having a rearwardly projecting portion of the fitting extending through an aperture in a wall of a pool, the water fitting has a light fitting integrally connected in adjacent relation with, and externally of the water fitting; the light fitting having a housing portion attached to the outer edge of the flange of the water fitting and extending in cantilevered relation in front of an imperforate portion of the pool wall.

The light fitting housing has a translucent cover; and power supply means connecting with the light assembly and extending through the pool wall by way of the water fitting, for connection to an externally located power source. Thus, the subject light fitting is located in unitary adjoined relation with the flange of a pool water fitting, to provide a slender, flush-fitting light source immediately adjacent to, and in substantially non-obstructing relation with a water fitting such that the flow characteristics of the pool circulation system are substantially unchanged. In a preferred embodiment, the subject light fitting has a housing of shallow depth, (i.e. thickness) having a diameter/depth ratio greater than two.

In the preferred embodiment for an above-ground pool, the combined water/light fitting of the present invention incorporates a water connection portion of the water fitting which extends rearwardly through the pool wall, and includes a conduit for the location of a connecting power cord, by which the light fitting is energized. The preferred light source in the light fitting is an array of light emitting diodes (LED's). In that embodiment of pool lighting system, the power cord connecting the light fitting with the power source, includes a free length of that cord located within the housing of the light fitting, to facilitate ready outward withdrawal of the LED array from the housing to a location above the surface of the pool.

The water fitting includes an electrical access conduit extending along a portion of the length of the fitting, which conduit accommodates the connecting power cord.

The water fitting has a rearwardly extending, externally threaded pipe portion with a locking nut in threaded engagement thereon for securing the water fitting to the pool wall.

The light source for the subject system comprises a shallow, substantially planar, circular array of light emitting diodes (LED's), powered by way of a step-down transformer from a domestic supply, by way of a ground-fault circuit breaker for purposes of electrical safety.

The light emitting diodes may have a light colour emission selected from the group consisting of red, green and blue LED's, being mounted on a printed circuit board, the LED array being releasably secured by attachment means to the light fitting housing.

The use of red-green-blue LED's enables the use of a programmed system to provide selected colour outputs, ranging over a wide colour spectrum.

In one embodiment of the present invention the light emitting diodes have a light colour emission selected from the group consisting of red, green and blue.

The use of an alternative light source such as a halogen light bulb is contemplated. This fits within the slender profile of the present light fitting housing portion of the combined water/light fitting pool light; also, a low voltage 12-volt supply circuit can be used with such a halogen light.

BRIEF DESCRIPTION OF THE SEVERAL VIEWS OF THE DRAWINGS

Certain embodiments of the present invention are described by way of illustration, without limitation of the scope of the invention thereto, other than as set forth in the present claims, reference being made to the accompanying drawings, wherein:

DETAILED DESCRIPTION OF THE INVENTION

Figure 1:
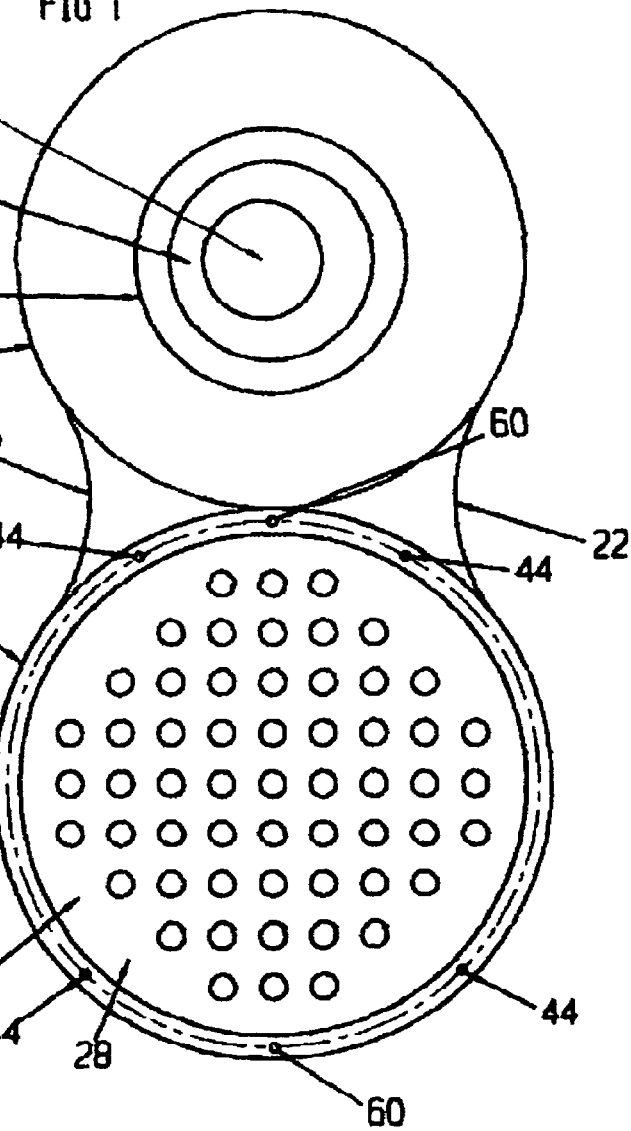
FIG. 1 is a front elevation of a pool combined water/light fitting embodiment in accordance with the present invention.
Figure 2:
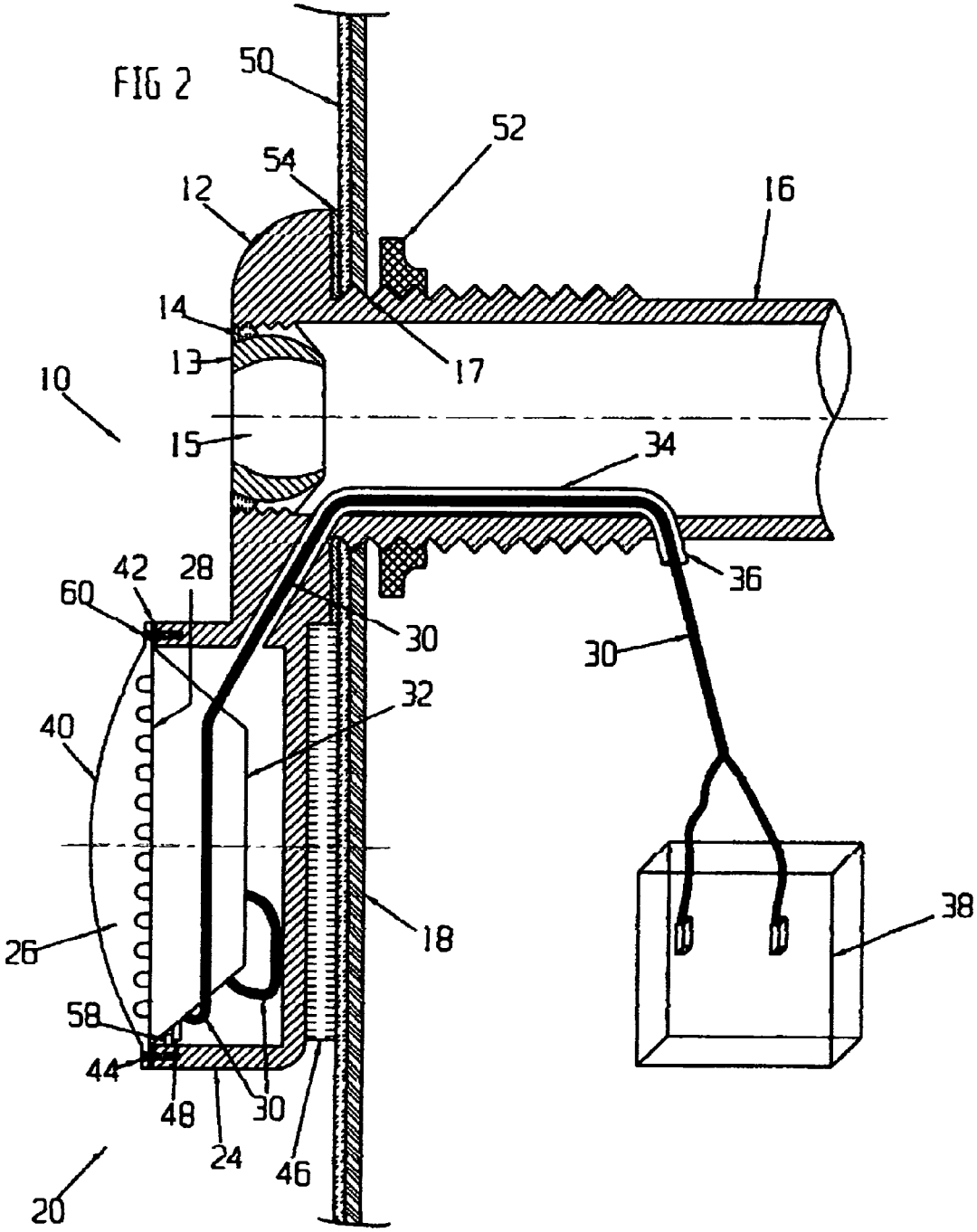
FIG. 2 is a side elevation view in section, showing a wall portion of an above-ground swimming pool with the subject combined water/light fitting in schematic, diametrical section; and, FIG. 3 is a side elevation view of a second embodiment, illustrated at a reduced scale.

Referring to FIGS. 1 and 2, a combined water/light fitting 10 in accordance with the present invention has a flanged water fitting portion 12 with a water inlet portion 16 for connection through an aperture 17 in the steel wall 18 of a pool. An annular "eyeball" directional nozzle 13 of predetermined discharge area 15 is secured in the outlet of the fitting 12 by way of a threaded retaining ring 14.

The water inlet portion 16 enables the attachment of a water line connection (not shown) to a filter and circulation pump (also not shown), by which the pool water is circulated and cleaned.

A light fitting portion 20 is integrally connected to the flange portion of the fitting 12, by way of two connecting web portions 22.

The light fitting portion 20 has a cylindrical body 24, containing an array of LED lights 26 mounted on a printed circuit board 28. An epoxy seal serves to waterproof the circuitry, enabling its submergence.

A connected power cord 30 includes spare turns of the cord 30 wound about a conical housing 32 within the light fitting portion 20, to enable withdrawal of the light array 26 from the light fitting portion 20.

The power cord 30 extends through the water fitting 12 and a connection conduit 34 that forms a part of the water inlet portion 16, the conduit exiting at 36.

The power cord 30 is connected with a step-down transformer/rectifier 38 to provide a 12-volt D.C. output. For safety purposes, the power supply is obtained through an electrical outlet (not shown) equipped with a Ground Fault Circuit Breaker.

The light fitting portion 20 has an outwardly convex translucent lens 40 mounted on an annular gasket 42, and secured by screws 44.

The assembled LED array 26, with board 28 and lens 40 is secured within the body 24 by way of detent 48 which disengageably engages behind rib 58. A screw 60 secures the LED/lens array in place.

The inlet portion 16 projects through an aperture 17 in the pool liner 50 and pool wall 18, being secured in place by a backing nut 52 screwed to the threaded inlet portion 16, (the nut 52 being shown partially screwed home).

The nut 52 serves to sandwich and locally compress the pool liner 50 and an annular sealing gasket 54 into sealing engagement between the flange portion 12 and the pool wall 18.

If maintenance or replacement of the LED array 26 is required, this may be carried out without drain-down of the pool water. Removal of the screw 60 and disengagement of detent 48 permits the light array 26/28/40 to be removed from the housing portion 20.

The spare turns of the cord 30 permit withdrawal of the light array above water, for servicing or replacement purposes.

A readily compressible foam gasket 46 adhered to the back of the light body portion 24 abuts the pool liner 50, serving to stabilize the installation.

Figure 3:
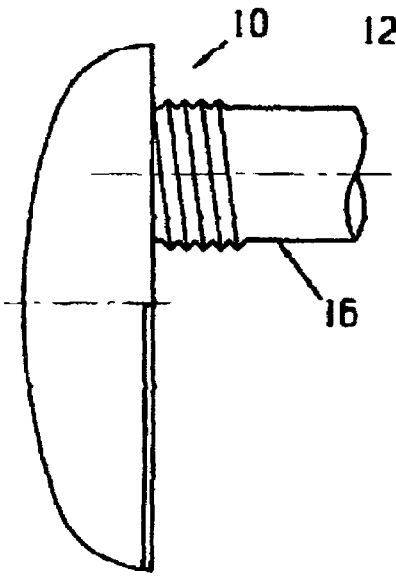

In the FIG. 3 embodiment, the side profile of the combined light fitting/circulation fitting 10' is unified, having a smooth curved profile with minimal protruberances, and affording substantially no hand-holds or foot-holds to users of the pool.

It is contemplated that the power cord 30 may project into the interior of the water inlet portion 16, without recourse to a connection conduit 34.

The invention claimed is:

1. A pool lighting system for use with a pool having an enclosure wall with an aperture of predetermined size extending through said wall, said lighting system having a flanged water fitting for sealing attachment to said pool wall to encompass said wall aperture, said water fitting having a water connection portion extending through said wall aperture for the transfer of water in relation to said pool; and a light fitting attached to the outer edge of said flanged water fitting, in externally extending off-set cantilevered relation therewith, for location of said light fitting in use, on an imperforate portion of said enclosure wall.

2. The pool lighting system as set forth in claim 1, wherein said light fitting contains a substantially planar array of light-emitting diodes.

3. The pool lighting system as set forth in claim 1, wherein said water fitting connection portion includes an electrical access conduit extending along said connection portion, to extend, in use, past said wall aperture.

4. The pool lighting system as set forth in claim 1, wherein said light fitting portion is of shallow depth, having a diameter substantially greater than its thickness.

5. The pool lighting system as set forth in claim 2, wherein said light emitting diodes are selected from the group consisting of red, green and blue light emitting diodes.

6. The pool lighting system as set forth in claim 2, wherein said electrical access conduit houses a power cord connecting said array of diodes to an external power source.

7. The pool lighting system as set forth in claim 6, wherein said external power source is a low-voltage power source.

8. A pool lighting system in combination with an above-ground pool having a pool enclosure wall with an aperture of predetermined size extending through said wall, said lighting system including a flanged water fitting having a water connection portion extending through said wall aperture with an externally threaded portion having a locking nut in threaded engagement thereon, securing said water fitting to said wall aperture in sealed, encompassing relation therewith; said flanged water fitting having a light fitting connected in adjoined, externally offset attached relation to the flange of said water fitting; said light fitting having a housing containing electric lamp means; and having a translucent cover; and power cord means connecting with said lamp means and extending through said water connection portion and said wall aperture, for connection to a power source located externally of said pool.

9. The combination as set forth in claim 8, said lamp means having a light array, including a plurality of light emitting diodes in substantially planar arrangement, having said translucent cover releasably secured to said housing; and attachment means securing said light array in releasably secured relation with said light assembly housing.

10. The combination as set forth in claim 9, said attachment means including a rib portion of said housing and a detent portion of said light array securing said light array in secured, disengageable relation with said housing.

11. The combination as set forth in claim 8, said power cord means including a length of spare turns of said cord located within said housing, in use to permit withdrawal of said lamp means to a position above the water level of said pool for servicing and replacement purposes.

* * * * *